United States Patent [19]

Rucker

[11] Patent Number: 4,664,720

[45] Date of Patent: May 12, 1987

[54] DIRECTIONAL TANK CLEANING PROCESS

[75] Inventor: James Rucker, Avery, Calif.

[73] Assignee: The Cloud Company, Avery, Calif.

[21] Appl. No.: 734,623

[22] Filed: May 15, 1985

[51] Int. Cl.[4] ..... B08B 7/00; B08B 9/04; B08B 3/00; B05B 17/04

[52] U.S. Cl. ..... 134/22.1; 134/22.18; 134/24; 134/34; 134/36; 239/7; 239/227

[58] Field of Search ..... 134/22.1, 22.18, 24, 134/34, 36; 239/7, 227

[56] References Cited

U.S. PATENT DOCUMENTS

| | | | |
|---|---|---|---|
| 2,029,795 | 2/1936 | Richard | 239/227 |
| 3,255,969 | 6/1966 | Saad | 239/227 |
| 3,326,468 | 6/1967 | Bristow et al. | 239/227 |
| 3,637,138 | 1/1972 | Rucker | 239/227 |
| 3,876,148 | 4/1975 | Cushing et al. | 239/227 |

FOREIGN PATENT DOCUMENTS

| | | | |
|---|---|---|---|
| 0741964 | 7/1980 | U.S.S.R. | 239/227 |

OTHER PUBLICATIONS

Gammajet, III, Operations Maintenance and Parts List Manual (first page) by Sybron/Gamlen.

Butterworth Tank Cleaning Machines for Crude Oil Washing, TC-2, 1980, USA.

Butterworth Directional Washer, 22nd St., Bayonne, N.J., DW-66, VPPTBW-473.

Portable Tank-Bottom Washing Machine, Arnold Co., Inc.

*Primary Examiner*—Andrew H. Metz

*Assistant Examiner*—William G. Wright

*Attorney, Agent, or Firm*—Townsend and Townsend

[57] ABSTRACT

A rotary spray nozzle directional tank cleaning machine has a first, stationary housing, a second housing mounted to the first housing for rotation about a first, typically vertical axis, and a third housing mounted to the second housing for rotation about a second axis. The second axis is at a first, acute angle to the first axis. The second housing is driven about the first housing through an impeller driven gear train by the pressurized cleaning liquid passing therethrough. The third housing is driven by a pair of bevel gears mounted to the first and third housings. One or more nozzles, mounted to the third housing, direct cleaning liquid along a third axis oriented at a second, acute angle to the second axis. The first and second, acute angles are preferably 45° to create a hemispherical spray pattern.

5 Claims, 2 Drawing Figures

DIRECTIONAL TANK CLEANING PROCESS

BACKGROUND OF THE INVENTION

Tank cleaning machines of the type having rotating spray nozzles have been used for some time. One type, driven by the pressurized cleaning liquid passing through it, is shown in U.S. Pat. No. 3,637,138 to Rucker, the inventor of the present invention. This tank cleaning machine, sold under the trademark GAMA-JET II, provides a generally spherical, omni-directional spray pattern. This spray pattern is produced by the movement of the spray nozzles about two perpendicular axes. The tips of the nozzles trace a spherical pattern reminiscent of a ball of twine. Because of the omni-directional nature of the spray pattern, it is quite useful for cleaning the entire interior surface of tanks or other containers.

Some situations, however, do not require or permit liquid cleaner to be sprayed in all directions. For example, open topped fermentation tanks are not good candidates for omni-directional tank cleaning machines. Sometimes, even if a container is covered, it may be desired to apply the liquid cleaner only below a certain point in the container. For example, in certain brewing processes once the tank is empty it should be thoroughly cleaned only below the upper liquid level. This is done to ensure that certain beneficial microbiological organisms are not removed or killed. Thus in these situations omni-directional spray patterns are also not acceptable. In other situations the tank or other container may only have been partially filled and need cleaning only below a certain level. Using an omni-directional tank cleaner would be quite inefficient in these circumstances. In addition, tanks often have a stubborn band of material at some intermediate position along the tank wall, typically at the upper liquid level. In these cases, omni-directional tank cleaning machines would need to be used much longer before the stubborn band is removed compared with the time it would take to clean the remainder of the tank.

SUMMARY OF THE INVENTION

Applicant's invention is directed to an improved directional tank cleaning machine which provides a truncated, semi-spherical spray pattern thus enabling it to be advantageously used in circumstances in which omni-directional tank cleaning machines either can not be used or would be used inefficiently.

The directional tank cleaning machine includes a first stationary housing, a second housing mounted to the first housing for rotation about the first, typically vertically oriented axis of the first housing, and a third housing mounted to the second housing for rotation about a second axis. The second housing is driven about the first housing through an impeller-driven gear train drive housed within the first housing. The impeller is rotated by pressurized cleaning liquid passing through the first housing. The cleaning liquid then continues through second and third housings and out through at least one nozzle mounted to the third housing. As the second housing, third housing and nozzles rotate about the first axis, the third housing is driven about a second axis, typically through a pair of bevel gears mounted to the first and third housings. The second axis is at a first, acute angle relative to the first axis; the third, nozzle axis is at a second, acute angle relative to the second axis. This provides a truncated spherical spray pattern instead of the omni-directional spherical spray pattern of the prior art tank cleaning machines.

A key feature of applicant's invention is that the spray pattern is concentrated at its upper and lower extremes, assuming the first axis is generally vertical. Thus by lowering the tank cleaning machine to the level corresponding to the upper level of the liquid within the tank, stubborn deposits at the former liquid surface are more quickly removed, compared with omni-directional tank cleaners, because of the spray concentration in this area. Further, a concentration of pressurized liquid is also produced vertically below the machine. Since many tanks have their drain holes situated directly below where the tank cleaning machine would be positioned, this helps to keep debris from building up on the bottom of the tank as could otherwise occur.

Preferably the first and second angles will both be 45°. This will produce a hemispherical spray pattern having a single flattened boundary region level with the machine. This is important because it allows the user to position the tank cleaning machine at the proper position since the upper boundary is level with the machine. This can be especially important when dangerous or noxious vapors or gasses are present since once the tank cleaning machine is lowered into the tank and begins operating, further adjustment as to height is at best inconvenient and may be dangerous.

Other features and advantages of the present invention will appear from the following description in which the preferred embodiment is set forth in detail with the accompanying drawings.

DETAILED DESCRIPTION OF THE PREFERRED EMBODIMENT

Figure 1:
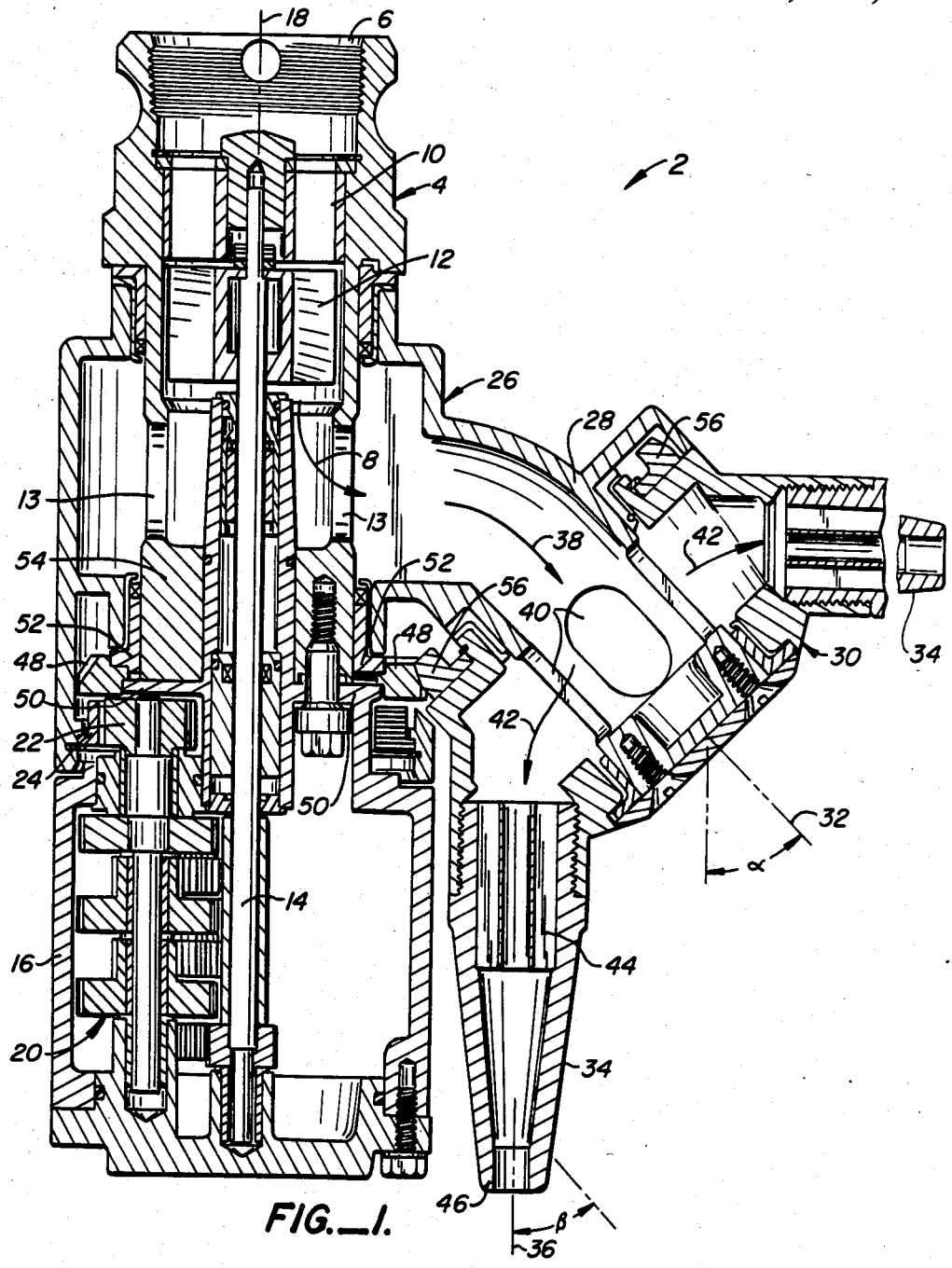
FIG. 1 is a side cross-sectional view of a tank cleaning machine made according to the invention.

Referring now to FIG. 1, a tank cleaning machine 2 is shown to include a first, stationary housing 4 having a fluid inlet 6 through which a cleaning liquid flows along a first fluid path 8 past a stator 10 and an impeller 12 and through openings 13 in housing 4. Impeller 12 is mounted to an impeller shaft 14 which extends down into a gear box portion 16 of stationary housing 4. Impeller shaft 14 defines a first, typically vertical axis 18 and drives a gear train 20 which terminates in a pinion gear 22. Pinion gear 22 drives an internal ring gear 24 which is secured to a rotatable second housing 26. Gear train 20 acts as a speed reducer so that housing 26 rotates at a much slower speed than impeller shaft 14. The above-described structure is similar in construction and operation to that disclosed in U.S. Pat. No. 3,637,138, the disclosure of which is incorporated by reference.

Second housing 26 includes an extension 28 extending downwardly and outwardly away from first axis 18. A third, rotatable housing 30 is rotatably mounted to extension 28 for rotation about a second axis 32 oriented at a first angle $\alpha$ relative to first axis 18. A pair of nozzles 34 are mounted to third housing 30, each oriented along a third, nozzle axis 36 at a second angle $\beta$ relative to second axis 32. In the preferred embodiment of FIG. 1, $\beta$ and $\alpha$ both equal 45°. Cleaning liquid thus passes along first fluid path 8, through openings 13, along a second fluid path 38 within second housing 26, through openings 40 in extension 28, along third fluid paths 42, past stream straighteners 44 and finally past nozzle tips 46 for discharge along nozzle axes 36.

A first, stationary bevel gear 48 is mounted between a flange extension 50 of gear box portion 16 and a ring 52 secured to a lower portion 54 of stationary housing 54. A second bevel gear 56 is secured to third housing 30 and positioned for engagement with first bevel gear 48. As second and third housings 26, 30 rotate about first axis 18 through the action of pinion gear 22 and ring gear 24, the engagement of bevel gears 48, 56 cause third housing 30 and nozzles 34 therewith to rotate about second axis 32 as well. Bevel gears 48, 56 have an unequal number of teeth chosen so that the spray pattern changes after each revolution. In the preferred embodiment, bevel gear 48 has 61 teeth while bevel gear 56 has 60 teeth so the spray pattern is retarded 6°.

Figure 2:
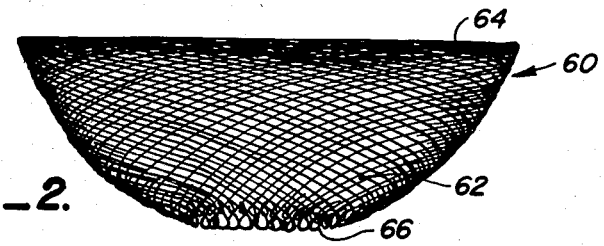
FIG. 2 is a representation of the spray pattern produced by tracing the tips of the nozzles during operation.

Turning now to FIG. 2, a nozzle tip pattern 60 is shown. Pattern 60 was taken from an elapsed time photograph in which impeller shaft was driven by a motor and a light emitting diode was mounted at each nozzle tip 46. The resulting image shows a uniform coverage over pattern 60. However, it is noted that there is a concentration of individual lines 62 near an upper edge 64 and a relatively small lower edge 66. Because of this, there is a concentration of spray by machine 2 at the vertical level of the tank cleaning machine and also directly below the machine. Thus, beside limiting the spray pattern to a generally hemispherical spray pattern, the top edge of which is even with the tank cleaning machine, stubborn deposits in the tank at the level of the tank cleaning machine are given a more concentrated spray of cleaning liquid because of the convergence of the paths near upper edge 64. Since tank drain holes are often situated directly below the tank entrance through which the cleaning machine is passed, the concentration of cleaning liquid directly below the tank cleaning machine helps keep dislodged contaminants from settling out and building up around the drain.

It should be noted that lower edge 66 does not curve downwardly. This reflects the fact that, as shown in FIG. 1, nozzle axis 36 when vertical is offset from first axis 18. Although spray pattern 60 actually has flattened upper and lower edges 64, 66, for practical purposes lower edge 66 can be ignored in this embodiment because of the relatively short distance between axes 18 and 36.

The invention has been described using the terms such as upper, lower, and vertical. These references are for convenience in referring to the embodiment in the disclosed orientation. Machine 2 can be used in any orientation desired in which case the relative terms upper, lower, vertical and so forth would no longer literally apply. However, applicant's invention is intended to cover these other orientations.

In use, the user mounts tank cleaning machine 2 to a liquid cleaner pipe (not shown) at fluid inlet 6. Machine 2 is then suspended into the container, room or region to be cleaned. Liquid cleaner is pumped through machine 2 whereupon it passes stator 10 and impeller 12, after which flows out of first housing 4 through openings 13. Impeller 12 rotates thus rotating impeller shaft 14 to drive pinion gear 22 of drive train 20. Pinion gear 22 drives ring gear 24 thus rotating second housing 26 about first axis 18. As second housing 26 does so, bevel gears 48, 56 rotate third housing 30 and nozzles 34 therewith about second axis 32, which is oriented at acute angle $\alpha$ relative to first axis 18. Nozzles 34 direct the cleaning liquid along third axis 36, third axis 36 being oriented at second acute angle $\beta$ relative to second axis 32. Thus, nozzles 34 rotate about first axis 18 and about second axis 32 as they direct the cleaning liquid along third axis 36.

Modification and variation can be made to the disclosed embodiment without departing from the subject of the invention as defined in the following claims.

I claim:

1. A spray cleaning method comprising the following steps:

positioning a liquid cleaner spraying machine at a chosen level proximate the surface to be cleaned;

providing the machine with liquid cleaner under pressure;

directing the liquid cleaner from the machine in a truncated ball-of-twine spray pattern, the truncated spray pattern having a truncated side defining a plane passing generally through the machine; and concentrating said spray pattern in a band adjacent the truncated side.

2. The cleaning method of claim 1 wherein the machine is positioned so the truncated side is horizontal.

3. The cleaning method of claim 2 wherein the truncated side is the upper side of the spray pattern.

4. A method for cleaning a portion of a tank below a predetermined level comprising the following steps:

positioning a liquid cleaner spraying machine in the tank at the predetermined level;

pumping liquid cleaner to the machine;

directing the liquid cleaner from the machine in a horizontally truncated ball-of-twine spray pattern, the spray pattern defining an upper, generally horizontal, truncated side; and concentrating the spray pattern in a band adjacent the truncated side to an annular portion of the tank at the predetermined certain level receives a concentrated spray of cleaner.

5. A method of spray cleaning only the approximate lower half of a tank comprising the steps of directing a stream of liquid cleaner under pressure by a series of passes whereby in each pass the liquid stream is initially directed at a preselected point of a side wall at a maximum height desired for cleaning and then directed diagonally downwardly said first side wall across the bottom of the tank and diagonally upwardly the opposite side wall to the same horizontal plane of the preselected point; and making a sufficient number of passes angularly displaced from the first pass and from every other pass to cause the stream of cleaner to impact on substantially all surfaces defining the approximately lower one-half portion of the tank being cleaned, whereby the overall spray pattern resembles a horizontally truncated ball of twine.

* * * * *